United States Patent [19]

Chatfield, Jr. et al.

[11] 4,271,909

[45] Jun. 9, 1981

[54] MODULAR FIRE FIGHTING APPARATUS

[75] Inventors: John F. Chatfield, Jr., Easton, Conn.; Donald C. Bryant, Palm Harbor; James C. Daly, Clearwater, both of Fla.; Friedolf Kamila, Long Meadow, Mass.

[73] Assignee: American Fire and Industrial Products Company, Tampa, Fla.

[21] Appl. No.: 970,110

[22] Filed: Dec. 18, 1978

[51] Int. Cl.[3] ..... A62C 31/22

[52] U.S. Cl. ..... 169/70; 173/57; 173/163; 175/170; 239/271; 251/101; 251/284; 285/307; 285/404; 403/351; 408/59

[58] Field of Search ..... 169/70; 239/271, 272, 239/458, 581, DIG. 22; 173/57, 73, 163; 175/170, 218; 408/59; 137/115, 116; 403/349-351; 285/307, 404; 251/93, 98, 99, 101, 103, 109, 116, 284

[56] References Cited

U.S. PATENT DOCUMENTS

| | | | |
|---|---|---|---|
| 1,339,882 | 5/1920 | Harris | 251/93 |
| 1,509,816 | 9/1924 | Kendrick | 251/99 |
| 2,250,670 | 7/1941 | Joy | 173/57 X |
| 2,590,789 | 3/1952 | Noyes | 403/350 X |
| 2,857,005 | 10/1958 | Medlock | 239/271 X |
| 3,865,194 | 2/1975 | Chatfield, Jr. | 169/70 |
| 4,018,292 | 4/1977 | Roll et al. | 251/109 X |
| 4,060,874 | 12/1977 | Furutsutsumi | 239/DIG. 22 X |
| 4,106,684 | 4/1977 | Urda | 251/109 X |
| 4,124,164 | 11/1978 | Bachman | 239/DIG. 22 X |

FOREIGN PATENT DOCUMENTS

| | | | |
|---|---|---|---|
| 45310 | 12/1910 | Austria | 403/350 |

*Primary Examiner*—David A. Scherbel
*Assistant Examiner*—Fred A. Silverberg
*Attorney, Agent, or Firm*—Robert H. Epstein

[57] ABSTRACT

Modular fire fighting apparatus includes a power module having a turbine driven by fluid, such as water, introduced at a supply inlet to a housing for the module, a drive shaft driven by the turbine and extending from a coupling face of the housing and a fluid outlet disposed at the coupling face of the housing, and various penetrating and extinguishing tool modules each having a housing within which are disposed a fluid receiving inlet and a driven member. The penetrating and extinguishing tool modules are each adapted to be mounted on the power module such that the driven member is releasably engaged with the drive shaft and fluid supplied to the power module housing is delivered to the penetrating and extinguishing tool module housing via the fluid outlet of the power module housing and the fluid receiving inlet of the penetrating and extinguishing tool module housing. The fluid supplied to the housing of the penetrating and extinguishing tool module can be supplied as a fire extinguishing agent to a fire area via a nozzle mounted on the penetrating and extinguishing tool module housing such that the fluid is used as a drive medium and as a fire extinguishing agent. The various penetrating and extinguishing tool modules are designed for simple installation on and removal from the power module and can include, for example, tools such as drills, impact members, expanding and contracting tools and circular and reciprocating saws.

35 Claims, 25 Drawing Figures

OUT
IN
2
5
22
24
28
30
32
34
112
114
116
118
122
129
134
168
190
214
216
217
218
246
248
250
251
252
254
256
260
262
264
272
288
290
292
294

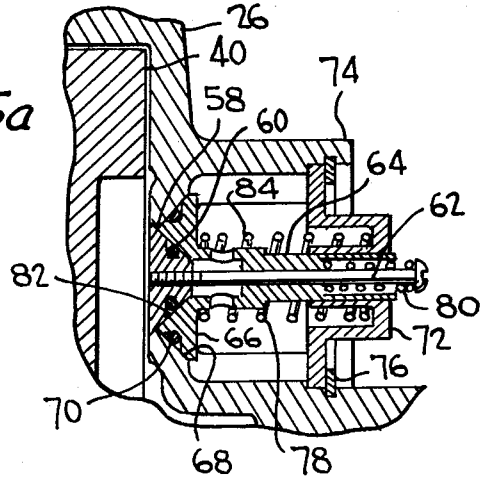
FIG. 5a
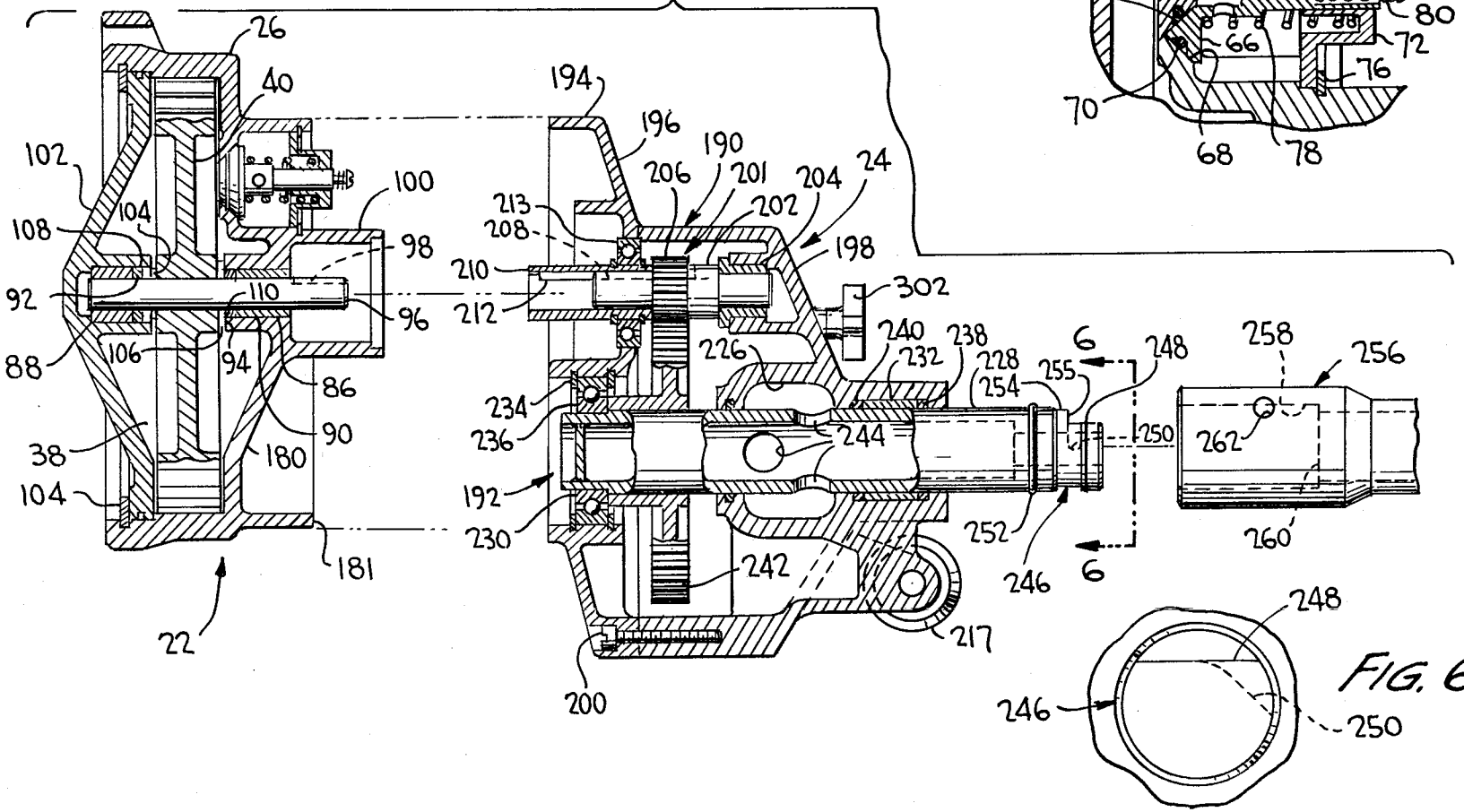
FIG. 5
FIG. 6

MODULAR FIRE FIGHTING APPARATUS

BACKGROUND OF THE INVENTION

1. Field of the Invention

The present invention pertains to fire fighting apparatus and, more particularly, to modular fire fighting apparatus including a penetrating tool driven by fluid to penetrate a structural barrier and a nozzle for introduction through an opening in the barrier produced by the tool to spray the fluid in a fire area as a fire extinguishing agent.

2. Discussion of the Prior Art

The hydraulically operated fire extinguishing tool described in U.S. Pat. No. 3,865,194 to Chatfield, Jr. represents a substantial step forward in the fire fighting field in that a single tool powered by a fire extinguishing fluid, such as water, can be utilized to penetrate a barrier in a building structure to permit the same fluid to thereafter be used as a fire extinguishing agent introduced through the opening produced by the penetrating tool. Accordingly, many of the hazards previously encountered in manually penetrating a building structure prior to insertion of a fire hose are avoided by the use of the tool of the Chatfield, Jr. patent. While the tool of the Chatfield, Jr. patent is highly advantageous relative to the prior art, the tool can be used for only a single application, and the turbine within the tool cannot be utilized interchangeably to drive other penetrating tools.

SUMMARY OF THE INVENTION

Accordingly, it is a primary object of the present invention to improve the fire extinguishing tool disclosed in the Chatfield, Jr. patent by producing a modular fire fighting apparatus capable of driving penetrating tools of widely varying natures while supplying fluid used to drive the tools as a fire extinguishing agent after penetration to a fire area.

The present invention has another object in that modular fire fighting apparatus is composed of a power module including a housing receiving a fluid for driving a turbine to rotate a drive shaft therein, and a penetrating and extinguishing tool module having a housing releasably secured to the power module housing with a driven member engaging the drive shaft and a fluid passage receiving fluid from the housing of the power module, the penetrating and extinguishing tool module utilizing any suitable penetrating tools, such as drills, saws, impact tools, and expanding and contracting extricating tools.

A further object of the present invention is to provide control features for a fluid driven power module of modular fire fighting apparatus to assure that a turbine impeller within the power module initially receives only small fluid flow to begin operation at a slow speed.

Another object of the present invention is to utilize a spray nozzle with various penetrating and extinguishing tool modules adapted to be releasably mounted on a fluid driven power module in modular fire fighting apparatus.

As another object of the present invention, a lever for controlling a drive control valve in a power module of modular fire fighting apparatus is pivotally mounted on the power module housing to extend along a tubular supply inlet handle such that an operator can hold the power module with a hand gripping the supply inlet handle such that the fingers of the hand can be further utilized to operate the lever to control the drive speed of a penetrating tool mounted on the power module.

The present invention has a further object in that separate drive control and spray control valves are used in a power module of modular fire fighting apparatus to individually control flow of fluid to drive a turbine within the power module and flow of fluid to a nozzle for spraying as a fire extinguishing agent.

An additional object of the present invention is to use a hydraulic coupling for connecting components of modular fire fighting apparatus, the hydraulic coupling including a generally cylindrical male coupling having a flat side surface extending from an end to a shoulder and a circumferential groove extending from the flat surface adjacent the shoulder and a generally cylindrical female coupling having a pin disposed therein to be longitudinally moved along the flat surface when the male and female couplings are assembled and rotatably moved into the groove with relative rotation between the male and female couplings. The hydraulic coupling provides a secure mechanical connection between components, and an O-ring seal around the male coupling and engaged by the female coupling assures a fluid-tight connection without requiring longitudinal wedging displacement thereby facilitating engagement and disengagement of the male and female couplings.

Yet another object of the present invention is to spray fluid utilized to drive a circular saw on the edge of the saw during operation.

Some of the advantages of the modular fire fighting apparatus of the present invention over the prior art are that the apparatus is light and easy to hold to facilitate use, the various penetrating and extinguishing tool modules can be simply and quickly interchanged on the power module for different applications, the drive control valve in the power module assures initially slow drive by the turbine and, further, is biased to a normally closed position such that when left unattended, the turbine will not be driven, and the modular fire fighting apparatus can be used to penetrate and spray fire extinguishing agents in heretofore unaccessible and extremely hazardous locations.

The present invention is generally characterized in modular fire fighting apparatus comprising a power module including a housing having a coupling face, a supply inlet for receiving fluid, a turbine chamber, a discharge path communicating with the turbine chamber for exhausting fluid from the housing, an outlet positioned along the coupling face, and passages establishing communication between the supply inlet and the turbine chamber and the outlet, a valve disposed in the passages for controlling fluid flow to the turbine chamber and the outlet, and a turbine drive disposed in the housing having an impeller rotatably mounted in the turbine chamber for rotation by fluid flow in the turbine chamber, and a drive shaft secured to the impeller for rotation therewith and extending through the coupling face, and a penetrating and extinguishing tool module including a housing having a coupling face for abutment against the coupling face of the power module housing, and an inlet for alignment with the outlet of the power module housing, a driven member rotatably mounted in the penetrating and extinguishing tool module housing to extend through the coupling face for releasable engagement with the drive shaft, and securing means for releasably mounting the coupling face of the penetrating and extinguishing tool module housing in abutment against the coupling face of the power module housing to position the inlet of the penetrating and extinguishing tool module housing in communication with the outlet of the power module housing and to engage the driven member with the drive shaft whereby the penetrating and extinguishing tool module can be simply installed on and removed from the power module.

Other objects and advantages of the present invention will become more apparent from the following description of the preferred embodiments taken in conjunction with the accompanying drawings.

BRIEF DESCRIPTION OF THE DRAWINGS

FIG. 5 is an exploded side view in section of the modular fire fighting apparatus of FIG. 1.

FIG. 5*a* is a side view in section of the vent and pressure relief valve of the power module.

FIG. 6 is a section taken along line 6—6 of FIG. 5 illustrating a hydraulic coupling for use with the modular fire fighting apparatus according to the present invention.

DESCRIPTION OF THE PREFERRED EMBODIMENTS

Figures 1, 1A, 1B, 1C:
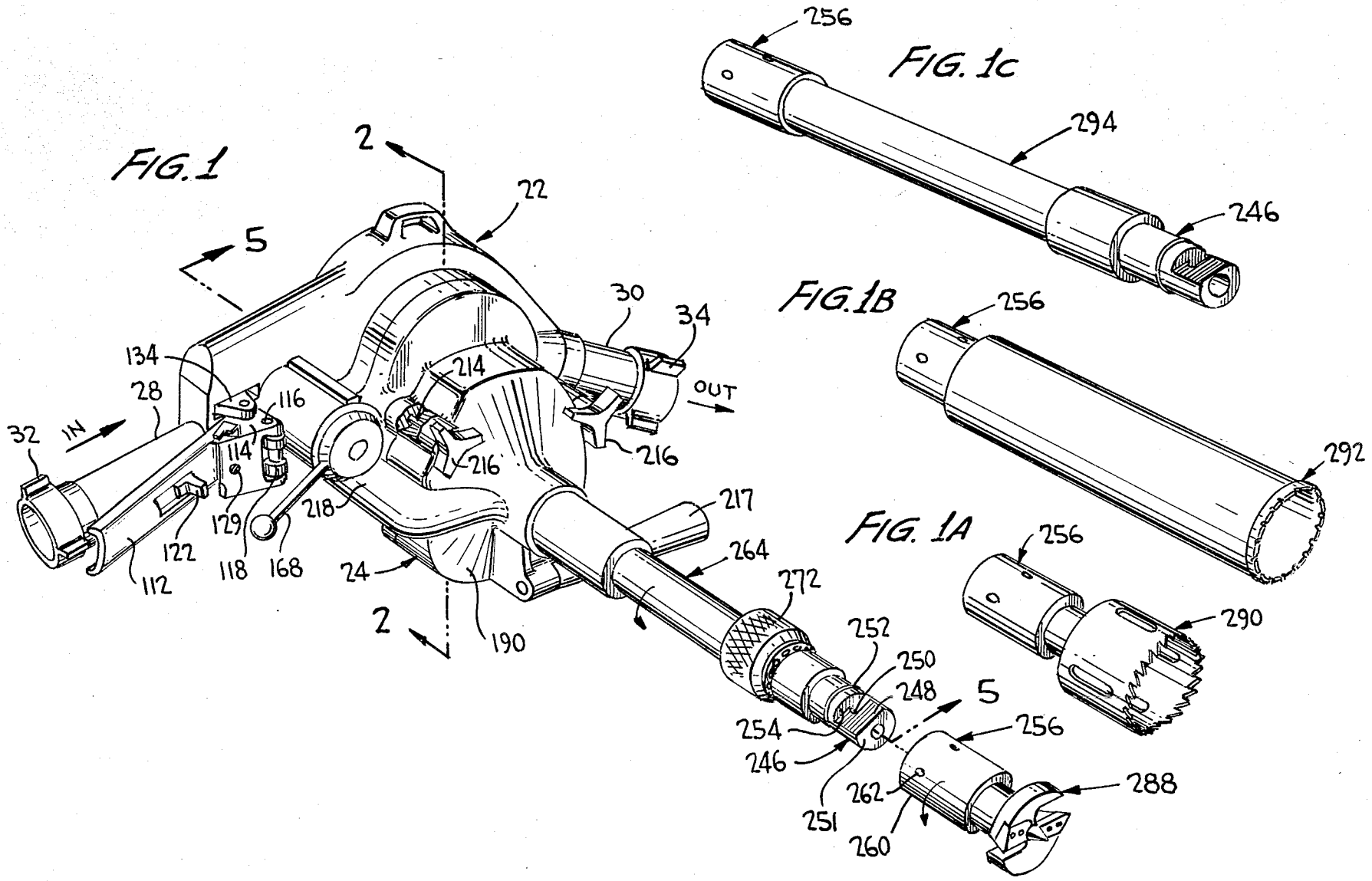
FIG. 1 is a perspective view of modular fire fighting apparatus according to the present invention.
FIGS. 1A and 1B are perspective views of various drill bits for mounting on the modular fire fighting apparatus of FIG. 1.
FIG. 1C is a perspective view of an extension for use with the modular fire fighting apparatus of FIG. 1.

Modular fire fighting apparatus according to the present invention is formed of a power module, generally indicated at 22, and a penetrating and extinguishing tool module, shown in FIG. 1 as a drill module 24, it being appreciated that any of the penetrating and extinguishing tool modules illustrated and described hereinafter can be mounted on the power module 22 in place of the drill module, as will be explained in further detail.

The power module 22 includes a housing 26 having handles 28 and 30 extending from opposite sides thereof, the handle 28 forming a tubular supply inlet for receiving a fluid for driving the power module and for extinguishing flames, and the handle 30 having a tubular configuration to form a discharge outlet for exhausting fluid driving the power module from the housing. While any fluid having characteristics to permit its use for driving a turbine and extinguishing flames can be utilized with the modular fire fighting apparatus of the present invention, the present invention will be described hereinafter utilizing water as the driving and fire extinguishing fluid. To this end, 1½ inch fire hose couplings 32 and 34 are mounted on the ends of handles 28 and 30, respectively, such that the power module 22 can receive water fom a pumper or hydrant and can dispose of water from the housing via standard fire hoses, the exhausted water, if desired, being recirculated to a supply tank.

Figures 2, 3, 4, 4A:
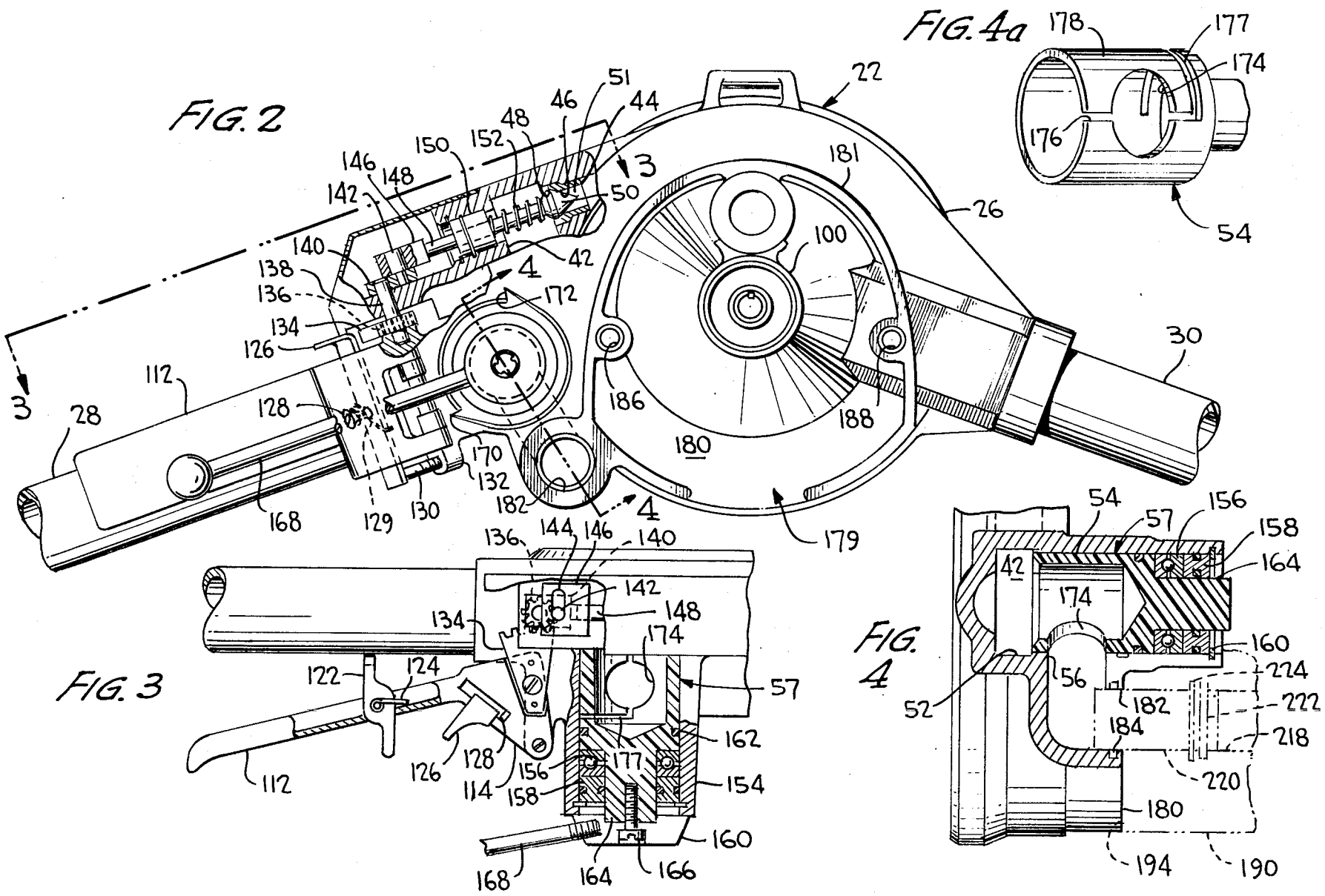
FIG. 2 is a front view of the power module of the modular fire fighting apparatus of FIG. 1 with parts broken away.
FIG. 3 is a section taken along line 3—3 of FIG. 2 illustrating the valve control mechanisms of the power module.
FIG. 4 is a section taken along line 4—4 of FIG. 2 illustrating the spray control valve of the power module.
FIG. 4A is a broken perspective of the valve member of the spray control valve.

The housing 26 is preferably made of cast aluminum to define a turbine chamber 38 within which is rotatably mounted a turbine impeller 40, as shown in FIG. 5. The turbine chamber 38 receives water from the supply inlet 28 via a passage 42 and a passage 44 communicating with the turbine chamber to supply water thereto tangentially to rotatably drive the impeller 40. A sleeve 46 is mounted in the passage 44 and has a tapered edge forming a valve seat cooperating with a conical valve member 50, as best shown in FIG. 2, the valve seat and the valve member forming a drive control valve 51 for controlling operation of the turbine. The supply inlet 28 also communicates with a passage 52 in which is disposed a valve member 54 for cooperation with a valve seat opening 56 to form a spray control valve 51 for controlling water flow for extinguishing purposes.

The discharge outlet 30 communicates with turbine chamber 38 to exhaust water from the housing 26, and communication between turbine chamber 38 and the ambient to prevent the creation of a vacuum in the turbine chamber is provided by a conical poppet valve member 58 carrying an O-ring seal 60 and secured to a screw 62 extending axially through a sleeve 64, as shown in FIG. 5*a*. The sleeve 64 carries an enlarged valve member 66 at its inner end having a tapered outer surface sealably engaging a tapered valve seat 68 communicating with the turbine chamber 38. A cup-shaped retainer 72 is held in place within an extension 74 of the housing 26 by means of a retaining ring 76, and a helical spring 78 is mounted in compression between retainer 72 and valve member 66 to bias the valve member against the valve seat 68 to maintain the valve in a normally closed condition. A helical spring 80 is mounted in compression between a head on the end of screw 62 and the sleeve 64 to bias valve member 58 against a valve seat formed by an internal tapered surface 82 of valve member 66.

The valve member 58 in combination with valve seat 82 forms a vacuum relief valve which is movable toward the turbine chamber when a vacuum is created therein due to ambient pressure on the opposite side of the valve member via openings 84 thereby permitting air to enter the turbine chamber to relieve or break the vacuum. When there is excess water pressure within the turbine chamber, the valve member 66 will be moved outwardly against the bias of spring 78 to permit water to exit the turbine chamber and be discharged from the housing 26.

The turbine impeller 40 is splined to a drive shaft 86 which is rotatably mounted in bearings 88 and 90 packed in seals 92 and 94, respectively. The drive shaft 86 has an end 96 with a longitudinal groove 98 formed therealong, the end 96 of the drive shaft protruding into a tubular extension 100 of the housing 26. A cover 102 defines one wall of the turbine chamber 38 and is mounted in the housing 26 by means of a retaining ring 104, the cover mounting bearing 88 for the drive shaft. Thrust bearings 106 and 108 are mounted around the drive shaft on opposite sides of the impeller 40, and seal spacers 108 and 110 are positioned between the seals 92 and 94 and thrust bearings 104 and 106, respectively.

The drive control valve 51 is operated by a lever 112 pivotally mounted via ears 114 on a pin 116 carried on the housing 26 adjacent inlet supply handle 28, the lever 112 being biased away from the handle 26 by means of a torsion spring 118 wound around pin 116 and having ends engaging the housing and the lever. The lever 112 has an opening 120 therein, and a safety lock 122 is pivotally mounted in the opening and biased by a torsion spring 124 toward the handle 28 to abut the handle and prevent pivotal movement of the lever. A release trigger 126 extends through slots 127 in the ears of lever 112 parallel with pin 116 and has an upper end bent and cut away to facilitate engagement by a finger of an operator. The trigger 126 is pivotally mounted within the lever via a screw 128 and is biased by means of a torsion spring 129 wound around screw 128 such that the bottom end of the trigger 126 is normally positioned to engage a stop 130 in the form of a threaded rod mounted on an ear 132 of housing 26. The abutment of the end of trigger 126 with stop 130 limits pivotal movement of the lever 112 toward the supply inlet handle 28; however, by cocking the trigger 126 by applying finger pressure to the upper bent end against the spring bias, the lower end of the trigger can be moved to avoid abutment with the stop 130 to permit full movement of the lever 112.

As best shown in FIGS. 2 and 3, a rack 134 is mounted on the top ear 114 of lever 112 and has teeth engaging a pinion 136 secured to a shaft 138 rotatably mounted in the housing and having an end secured to a pivot block 140 carrying a pin 142 offset from the axis of shaft 138 so as to be rotatable therearound, the pin 142 being captured in a slot 144 in an adaptor block 146. The block 146 is secured to a valve stem 148 which carries valve member 50 and is mounted for reciprocating movement in a gland 150 sealably disposed within the housing to prevent fluid flow therethrough. The valve member 50 is biased away from the gland 150 by means of a helical spring 152 mounted in compression between the gland and the valve member.

The valve member 54 of spray control valve 57 has a generally cylindrical configuration, as best shown in FIG. 4A, and is disposed in a cylindrical cavity 154 in housing 26 so as to be rotatable therein via bearings 156 and 158 held in place by a retaining ring 160, a O-ring 162 being mounted in an annular groove in the outer surface of the valve member to seal the cavity 154 against flow of water therethrough. The valve member 54 has a stem 164 extending through the bearings 156 and 158 and secured via a central screw 166 to a control handle 168 which is movable approximately 105° between a stop 170 corresponding to closure of the spray control valve and a stop 174 corresponding to the nozzle control valve being fully open. The valve member 54 is preferably made of a relatively hard plastic material and has a central aperture 174 therein for alignment with passage 56 to control flow from the supply inlet 28. The body of the valve member has a slot 176 therein extending parallel to the axis of the valve member from the peripheral end to communicate with a slot 177 extending approximately 180° circumferentially around the valve member. Thus, the valve member includes a relatively resilient flap portion 178 defined by slots 176 and 177 which is responsive to water pressure to flex to increase sealing engagement against the valve seat opening 56 in cavity 154.

As best shown in FIG. 2, the housing 26 has a coupling face generally indicated at 179 and defined by a side wall 180 and a peripheral wall 181 extending partially therearound and in which is defined an outlet 182 at the end of passage 56, the wall of the outlet 182 having an O-ring 184 therein to permit sealing engagement of the outlet with an inlet of the penetrating and extinguishing module 24. A gap 185 is formed in the bottom of the peripheral wall 181 to define an opening through which excess water in the turbine chamber can be drained from the housing via valve member 66. The tubular extension 100 and the drive shaft 96 protrude substantially transversely from the coupling face 179 of the housing in substantially parallel alignment with the axis of the outlet 182 such that a penetrating and extinguishing module can be secured in face-to-face relation with the power module to receive water via outlet 182 and to have a driven member engaged by the drive shaft 86. To this end, peripheral wall 181 has internally threaded holes 186 and 188 on opposite sides thereof to receive threaded bolts extending through the penetrating and extinguishing module, as will be explained in more detail hereinafter.

In accordance with the present invention, the power module 22 can be utilized with any suitable penetrating and extinguishing module; and, accordingly, the operation of the power module will be explained at this time in order to facilitate understanding of the operation of the power module when combined with a suitable penetrating and extinguishing module. Water supplied via supply inlet 28 is initially prevented from flowing through the housing 22 in that control handle 168 is moved to abut stop 170 to close the spray control valve 57 by positioning aperture 174 in valve member 54 away from passage 56 and positioning flap portion 178 adjacent valve seat opening 56 such that water pressure forces the flap portion against cavity 154 to seal the passage 56. The safety lock 122 is normally biased by spring 124 to abut supply inlet handle 28 and prevent movement of lever 112; however, once the safety lock is moved against the bias of spring 124, the lever can be moved an initially limited distance until release trigger 126 abuts stop 130. Pivotal movement of lever 112 moves rack 130 to rotate pinion 136 and, in turn, rotate pin 142 counterclockwise looking at FIG. 3 to move valve stem 148 and valve member 50 to the left looking at FIG. 2 to open the drive control valve 51 and permit water flow through passages 42 and 44 into the turbine chamber 38 to initiate movement of the turbine impeller 40 at a slow speed. Once drive of the turbine impeller is initiated, the release trigger 126 is operated to move the end of the trigger such that stop 130 no longer engages the same thereby permitting the lever 112 to be moved all the way against the supply inlet handle 28 to drive the turbine impeller at full speed. Since the lever 112 is biased away from the supply inlet handle 28 by spring 118, if the force applied to the lever is released or if the power module is left unattended, the lever will be moved to automatically close the drive control valve; and, once the lever is moved to close the drive control valve 51, the safety lock will return to its normal position due to spring 124 to assure that the turbine cannot be inadvertently operated.

The spray control valve 57 remains closed at this time; or, if a small amount of water is desired to be supplied to the penetrating area, the spray control valve can be slightly opened by clockwise movement, looking at FIG. 2, of handle 168 to provide the desired amount of water, the movement of the handle 168 rotating the valve member 54 to align a portion of aperture 174 with the valve seat passage 56 for flow of water through outlet 182.

The drill module 24, illustrated in FIGS. 1 and 5 as being mounted on the power module 22, includes a housing 190 formed of a lightweight material, such as cast aluminum, and having a coupling face 192 defined by a peripheral wall 194 of a configuration and size to abut the peripheral wall 181 of the coupling face 179 of the power module, the peripheral wall 194 extending from an adapter cover 196 mounted on a main body 198 of the housing 190 via screws 200. A driven member 201 is mounted in housing 190 and includes a shaft 202 rotatably mounted at one end in a bearing 204 and centrally carrying a gear 206. The shaft 202 has a groove 208 therein, and a sleeve coupling 210 engages shaft 200 via an elongate rib 212 received in groove 208, the sleeve coupling being rotatably mounted in a bearing 213 and being designed to similarly engage the end 96 of drive shaft 86 of the power module by rib 212 being received in groove 98. In this manner, the drive shaft 86 and the driven member 201 are splined together for positive drive once the drill module 24 is mounted on the power module.

Elongate bolts 214 extend through bores in opposite sides of the housing 190 and are rotatable therein while being captured via retaining rings (not shown) to prevent longitudinal movement, the bolts 214 being of a length to be received in the threaded holes 186 and 188 in the power module. On the ends of the bolts are three-prong knobs 216 to facilitate tightening of the bolts within the threaded holes to secure the drill module to the power module. A handle 217 is mounted at the front of the housing 190 such that with the drill module firmly secured to the power module, the modular fire fighting apparatus can be held by any of handles 28, 30 and/or 217.

Along the side of the housing is a passage 218 for communication with the outlet 182 of the power module, the passage 218 forming an inlet in which is received a tubular connector 220 held in place by a retaining ring 222 and sealed by means of an O-ring 224, as shown in phantom in FIG. 4. The tubular connector 220 extends into outlet 182 of the power module and is sealed by means of O-ring 184 such that, once the bolts 214 are tightened, the tubular connector 220 sealably provides communication between passages 56 and 218. The passage 218 terminates at a central cavity 226 through which extends a hollow drill spindle 228 having an end rotatably mounted in ball bearings 230 and a distal portion rotatably mounted in bearings 232. The bearing 230 is held in place by a retaining ring 234, and a retaining ring 236 prevents longitudinal movement of the spindle 228 to the right looking at FIG. 5 while longitudinal movement to the left is prevented by a shoulder formed on the spindle and engaging the bearing 236. The bearing 232 is packed between an annular seal 238 and an O-ring 240. The spindle 228 is splined with a large gear 242 meshing with gear 206 such that rotation of the drive shaft 86 is imparted to the spindle 228 via the splined connection between the drive shaft and the driven member and the intermeshing of gears 206 and 242. The spindle 228 has openings 244 therein positioned within cavity 226 such that water supplied through inlet passage 218 flows via cavity 226 and openings 244 inside the spindle 228, the proximal end of the spindle being closed such that water flows out of the spindle to the right looking at FIG. 5.

The spindle 228 terminates at a male coupling, generally indicated at 246, includes a notched end defining a flat side surface 248 with a curved groove 250 extending circumferentially therefrom at a position spaced from an end 251 of the spindle, as best illustrated in FIGS. 6, 7, 8 and 9. An O-ring 252 is mounted around the spindle at a position spaced from a shoulder 254 formed at the end of the flat surface 248. A female coupling, generally indicated at 256, has a central recess 258 formed in a cylindrical member 260, and a pin 262 is secured in the recess 258 extending transversely and spaced from the axis thereof in chord-like orientation such that the pin can be received along the flat surface 248 when the male coupling 246 is inserted within the female coupling 256. The diameter of the recess 258 is substantially the same as the outer diameter of the spindle 228 such that when the male and female couplings are engaged, the O-ring 252 will provide a fluid-tight seal to prevent leakage of water. The female coupling is forced over the male coupling until the pin 262 engages shoulder 254 at which time the female member is rotated clockwise looking at FIGS. 8 and 9 to move the pin 262 into the curved groove 250.

With the male and female couplings engaged, rotational movement of the spindle 228 in a counterclockwise direction looking at FIG. 1 is imparted to the cylindrical member 260 by the engagement of pin 262 in groove 250 with a wedging action while longitudinal displacement of the female coupling is prevented by abutment of pin 262 with the side wall of groove 250. The male and female couplings can be simply disengaged by turning the female coupling 256 counterclockwise looking at FIGS. 8 and 9 to align pin 262 with flat surface 248 thereby permitting longitudinal displacement of the female coupling relative to the male coupling 246. The O-ring 252 forms a seal to prevent fluid leakage while not unduly interfering with disengagement of the male and female couplings due to its location and its parallel alignment with groove 250 which is transverse to the axis of the male coupling rather than at an angle thereto. The transverse alignment of groove 250 provides secure engagement of various components of the modular fire fighting apparatus of the present invention and will be given the same reference numbers as above and not described again for the sake of brevity.

Figure 7:
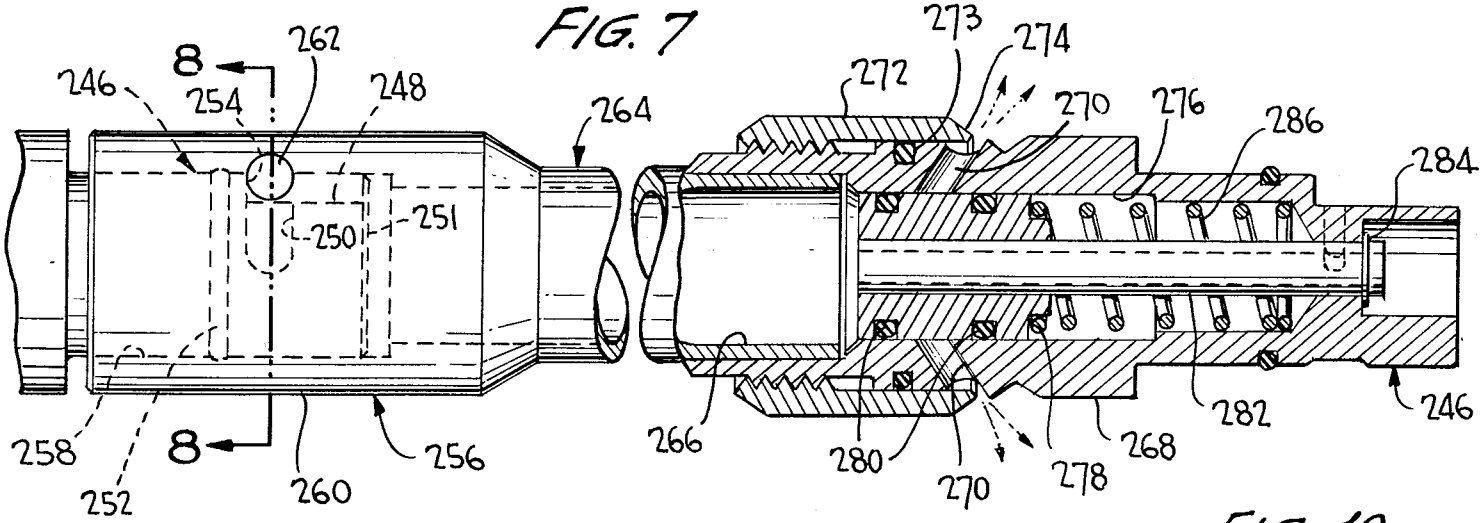
FIG. 7 is a side view partly in section of the nozzle of the modular fire fighting apparatus of the present invention.
Figure 10:
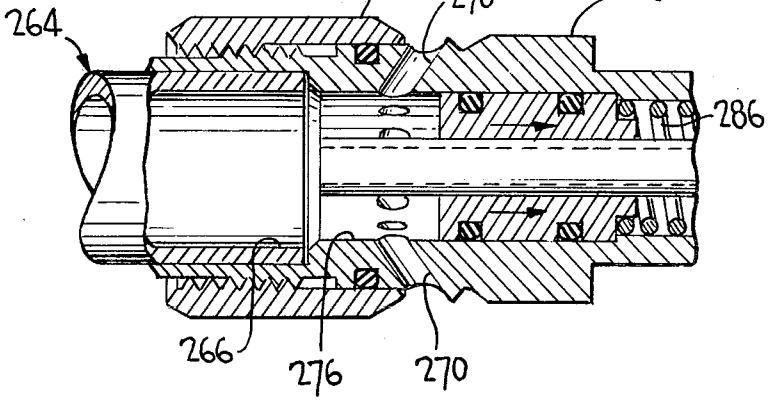
FIG. 10 is a side view in section illustrating the nozzle during spraying operation.
Figure 9:
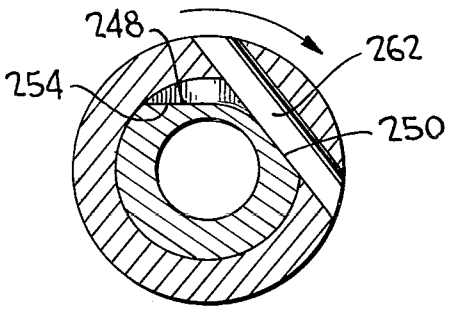
FIG. 9 is a view similar to FIG. 8 with the hydraulic coupling in a locked position.
Figure 8:
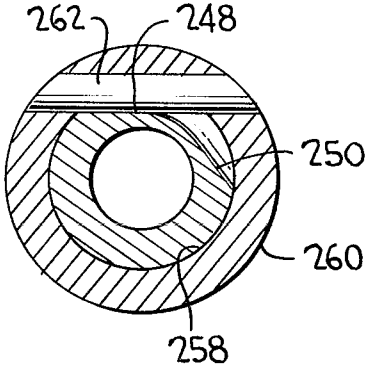
FIG. 8 is a section taken along line 8—8 of FIG. 7 illustrating the hydraulic coupling during assembly.

The female coupling 256 is formed on the end of a hollow cylindrical nozzle 264 which includes cylindrical member 260 having an end 266, as best illustrated in FIG. 7, to which is secured a cylindrical spray head 268 terminating in a male coupling 246. The spray head 268 has a series of passages 270 circumferentially spaced therearound and extending angularly from the internal bore of the nozzle. An adjustable collar 272 threadedly engages external threads on the spray member 268 and is sealed by means of an O-ring 273, the collar having a peripheral lip 224 adapted to be moved over the passages 270 by turning the collar to control the size of the orifices thereof and thereby control the spray pattern of water exiting through the passages. Within a central bore 276 of the spray head is slidably mounted a piston 278 carrying spaced O-rings 280, the piston being secured to a central tube 282 which is held in the end of the spray head by means of a retaining ring 284 and the piston being biased to the left looking at FIG. 7 by means of a helical spring 286 mounted on compression between an end wall of the central bore 276 and the piston 278. Water flowing through the spindle 228 and the nozzle 264 will be prevented from flowing out of passages 270 with the piston 278 positioned as illustrated in FIG. 7 while a small amount of water flows through tube 282. Once the force of the water pressure exceeds the bias of spring 286, however, the piston will be moved to the right to compress spring 286 and permit fluid flow through passages 270 for fire extinguishing purposes, as illustrated in FIG. 10.

A wood bit, generally indicated at 288, has a female coupling 256 formed on the end thereof for engagement with male coupling 246 on the end of nozzle 264; or, if desired, the nozzle 264 can mount a metal hole saw 290, as illustrated in FIG. 1A, or a masonry bit 292, as illustrated in FIG. 1B, both the saw 290 and the bit 292 having female couplings 256 for engagement with male coupling 246. If it is required that the length of the drill module be increased, one or more extensions 294 illustrated in FIG. 1C can be attached to the male coupling 246 of the spindle 228 prior to attachment of the nozzle 264. To this end, the extension 294 carries a female coupling 256 on one end and a male coupling 246 on the other end.

In operation, a fire hose is connected with coupling 32 at the supply inlet 28 such that water under pressure from a pumper or a hydrant is supplied to the housing of the power module 22 while an exhaust hose is connected with the discharge outlet 30 via coupling 34. The spray control valve lever 168 is moved down against stop 170 to close the spray control valve 57; and, with the appropriate extensions and bits or saws coupled with the drill module, the apparatus is gripped with one hand holding the supply inlet handle 28 and the other hand holding either handle 217 or discharge outlet handle 30. At this time, water can be supplied to the apparatus; and, if it is desired to supply water to the barrier to be penetrated, such as when cutting masonry materials, the spray control valve 57 is opened slightly so that water can flow freely through the spindle 228, the nozzle 264 and the tube 282 out through the bit secured to the nozzle. If the spray control valve is opened too wide, the piston 278 will be displaced by water pressure to spray water from passages 270; however, with the spray control valve properly adjusted, water will exit from the bit while the piston remains in place to seal off the nozzle passages 270.

With the drill bit positioned flush against a barrier, the safety lock 122 is pivoted with a finger of the hand grasping handle 28, and the turbine speed control lever 112 can then be gradually squeezed to move toward the handle. As discussed above, initial movement of the lever 112 is limited by abutment of trigger 126 with stop 130 thereby permitting only slow initial rotation of the turbine impeller 40 within the power module such that the drill starts at a slow speed until the barrier material has been initially scored or cut. Once the drill has initially cut into the barrier material, the speed of rotation of the drill can be increased by pivoting the release latch trigger 126 to avoid the stop 130 and squeezing the speed control lever 112 to open drive control valve 51 wide and permit the turbine to run at full speed. Once the drill has penetrated through the barrier material, the lever 112 is released to close the drive control valve and the drill module is moved foward to extend the nozzle 264 into the fire area. Thereafter, the spray control valve 57 is fully opened to divert all of the water supplied to the apparatus through the spindle 228 and nozzle 264 and out via spray passages 270, the piston 278 having been moved to the position illustrated in FIG. 10 by the water pressure.

Figure 11:
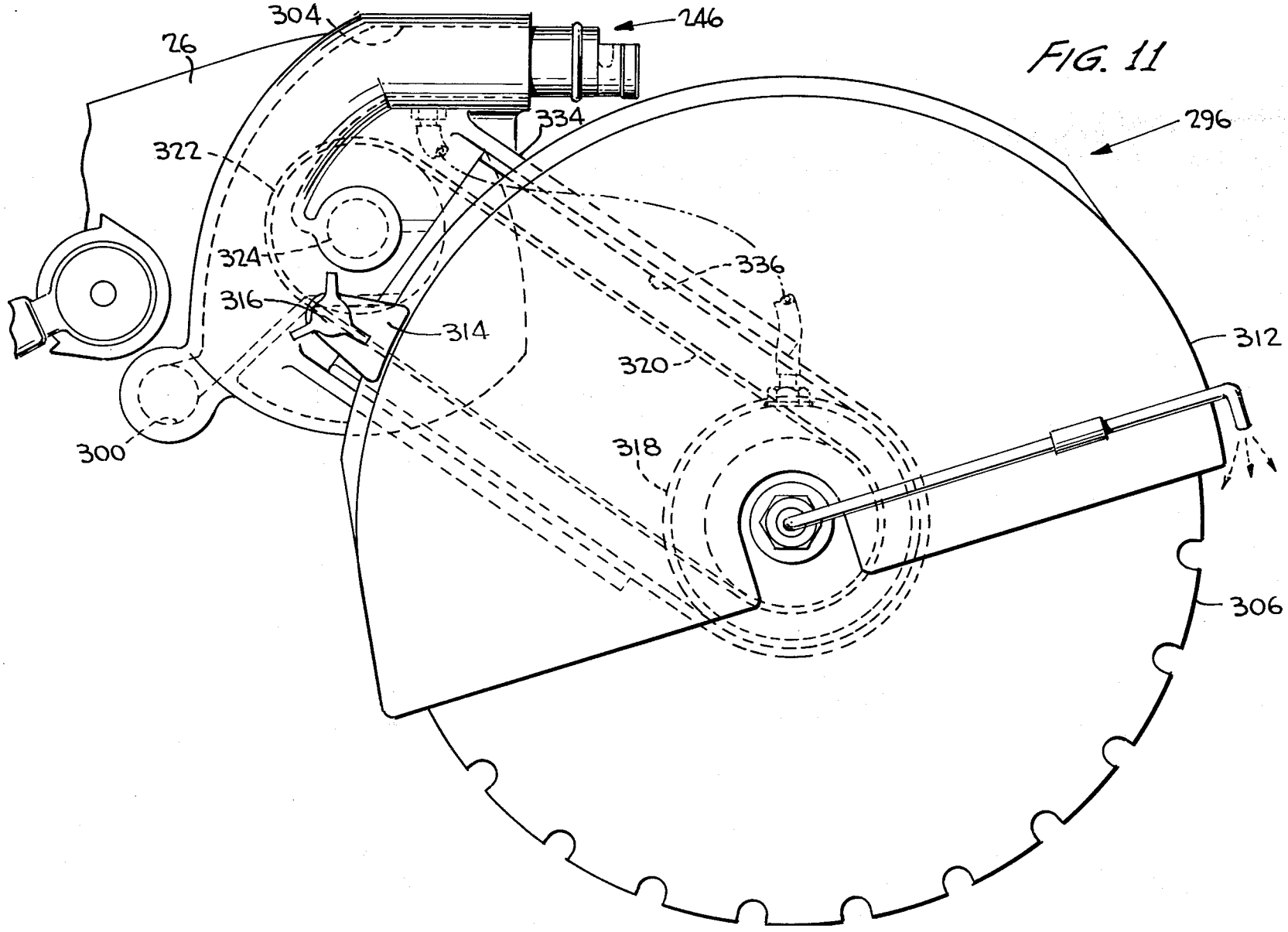
FIG. 11 is a side view of a circular saw module for installation on the power module of the modular fire fighting apparatus of the present invention.
Figures 12, 13:
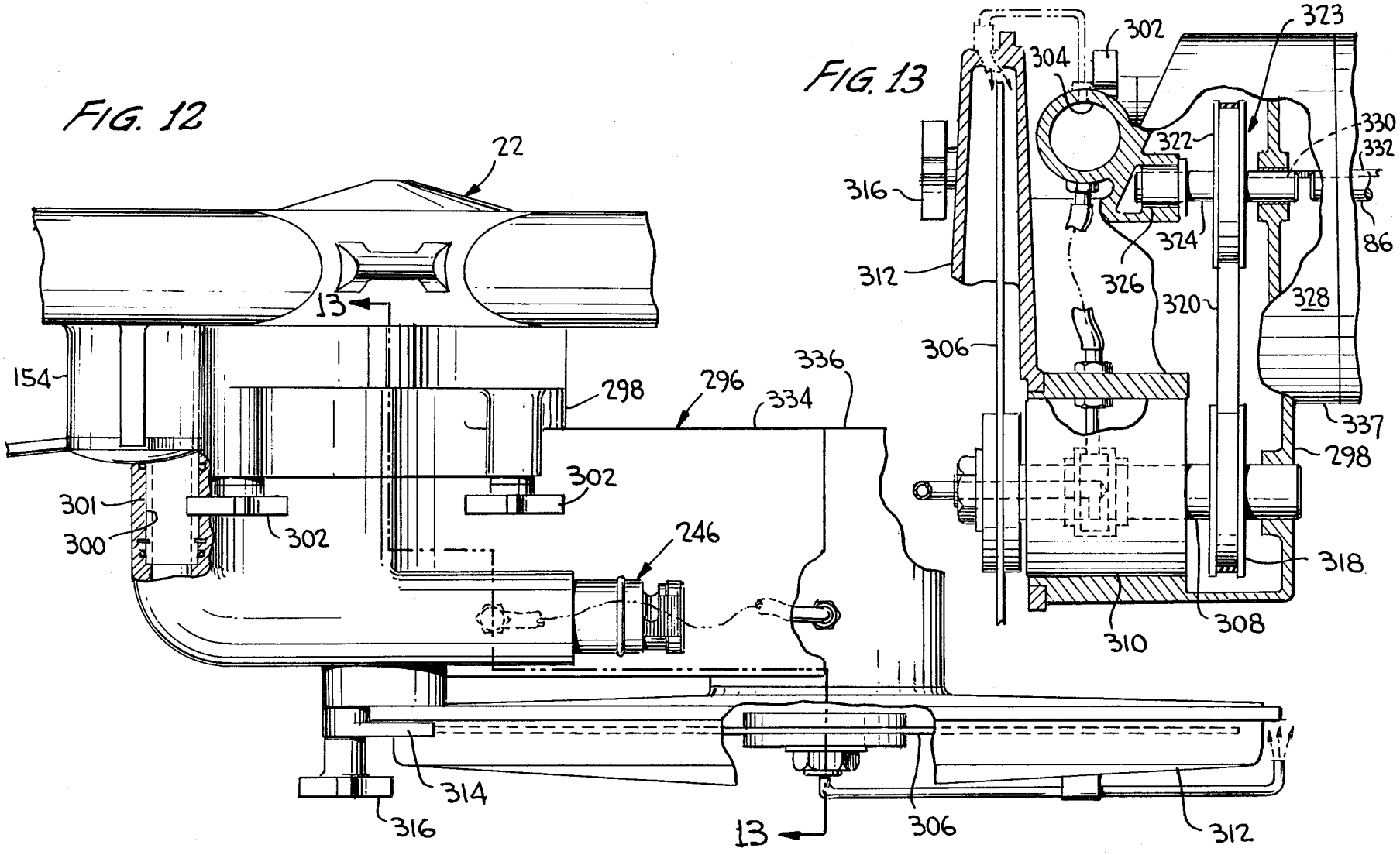
FIG. 12 is a top view of the circular saw module of FIG. 11.
FIG. 13 is a section taken along line 13—13 of FIG. 12 illustrating the drive mechanism for the circular saw module.

A circular saw module 296 is illustrated in FIGS. 11, 12 and 13 and can be mounted on the power module 22 in the same manner as the drill module 24. To this end, the circular saw module 296 includes a housing 298, preferably made of cast aluminum, including an inlet passage 300 having a tubular connector 301 extending into outlet 182 of the power module in the same manner as described above with respect to the drill module. Similarly, a pair of elongate bolts are disposed on opposite sides of the housing 298 and carry knobs 302 to permit the bolts to be received in the threaded openings 186 and 188 of the power module for securing the circular saw module thereto in the same manner as the drill module described above. The passage 300 extends upward to an outlet 304 from which extends a hollow male coupling 246 for receiving the female coupling of nozzle 264 such that the nozzle will extend over and alongside of a circular saw blade 306 rotatably mounted on a shaft 308 supported in bearings 310 within housing 298, the shaft having an axial passage 309 extending partially therethrough. A semi-circular shield 312 surrounds approximately half of the saw blade 306 and is rotatable about the axis of the saw blade and held in position by a clamp 314 under the control of a threaded knob 316, as best shown in FIG. 12. The shaft 308 has a pulley 318 mounted thereon driven by a belt 320 extending around a pulley 322 secured to a driven member 323 including a shaft 324 mounted in bearings 325 and 326 within the housing 298. The end of shaft 324 has a groove 327 for receiving a rib of a sleeve coupling 328 engaging the drive shaft 86, as partly illustrated in FIG. 13, such that the driven member and the drive shaft are splined together in the same manner as the driven member of the drill module, as explained above. The housing 298 is formed of two telescoping parts 329 and 330, as best illustrated in FIG. 11, such that the tension on the belt can be controlled by sliding movement of the two parts which can be held together by screws, not shown. The housing part 329 houses the driven member 323 and has a coupling face defined by a peripheral wall 330 adapted to abut the peripheral wall 181 of the coupling face 179 of the power module while the housing part 330 houses the pulley 318 and the shaft 308 mounting the saw blade 306.

Water passing from inlet 300 to outlet 304 also passes through a fitting in the bottom of the outlet and a flexible tube 331 to a fitting extending through housing part 330 to communicate with passage 309 in shaft 308 via a rotatable fitting 332. A rotatable fluid-tight connection 333 is mounted on the end of shaft 308 in communication with passage 309 and a tube 334 extending radially along a bottom edge of the shield 312 to a nozzle 335 positioned to spray water on the cutting edge of saw blade 306.

Alternatively, water can be sprayed on the cutting edge of saw blade 306 by means of a nozzle 335' mounted inside the shield 312 which receives water from outlet 304 via a port therein, a flexible tube 336 and a fitting 337 carrying the nozzle, as shown in phantom in FIG. 13. The fitting extends through a peripheral slot in the outer edge of the shield and has a flange extending therefrom to cover the portion of the slot adjacent the nozzle such that the shield can be rotatably positioned on the saw blade.

Operation of the circular saw module 296 in combination with the power module is similar to that described above with respect to the drill module relative to the operation of the drive control and spray control valves with water being supplied to the cutting edge of the saw blade under the control of the spray control valve 57 which would be maintained slightly open during cutting operations. The rotation of drive shaft 86 by means of the turbine within the power module rotates pulley 322 to rotate pulley 318 via belt 320 and, therefore, rotate shaft 308 and circular saw blade 306; and, once an appropriate opening is cut in a barrier, the modular fire fighting apparatus can be positioned such that the nozzle 264 is directed within the opening while the spray control valve is fully opened to discharge water in the fire area.

Figure 15:
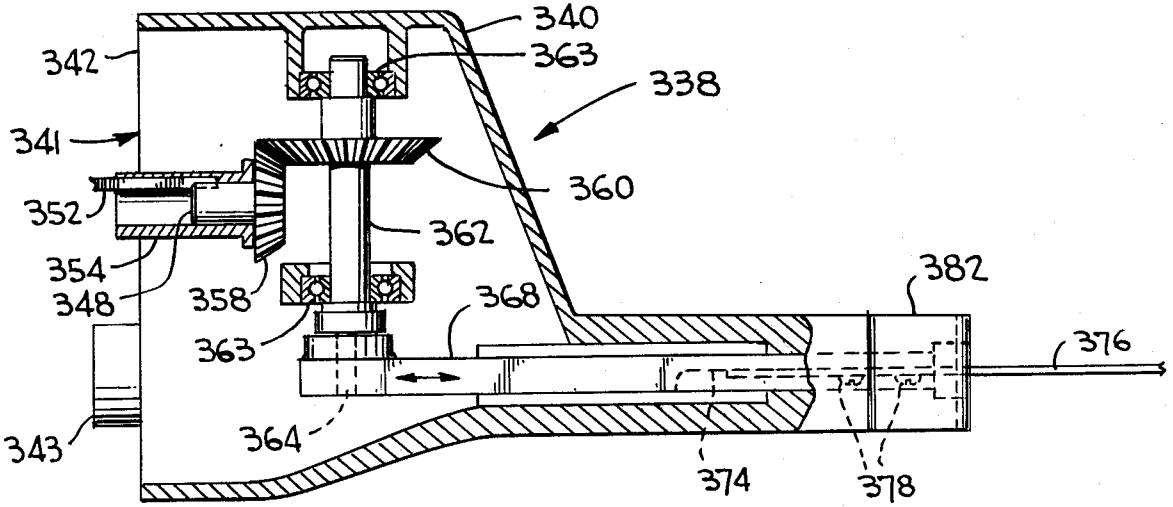
FIG. 15 is a top view partly in section of the reciprocating saw module of FIG. 14.
Figure 14:
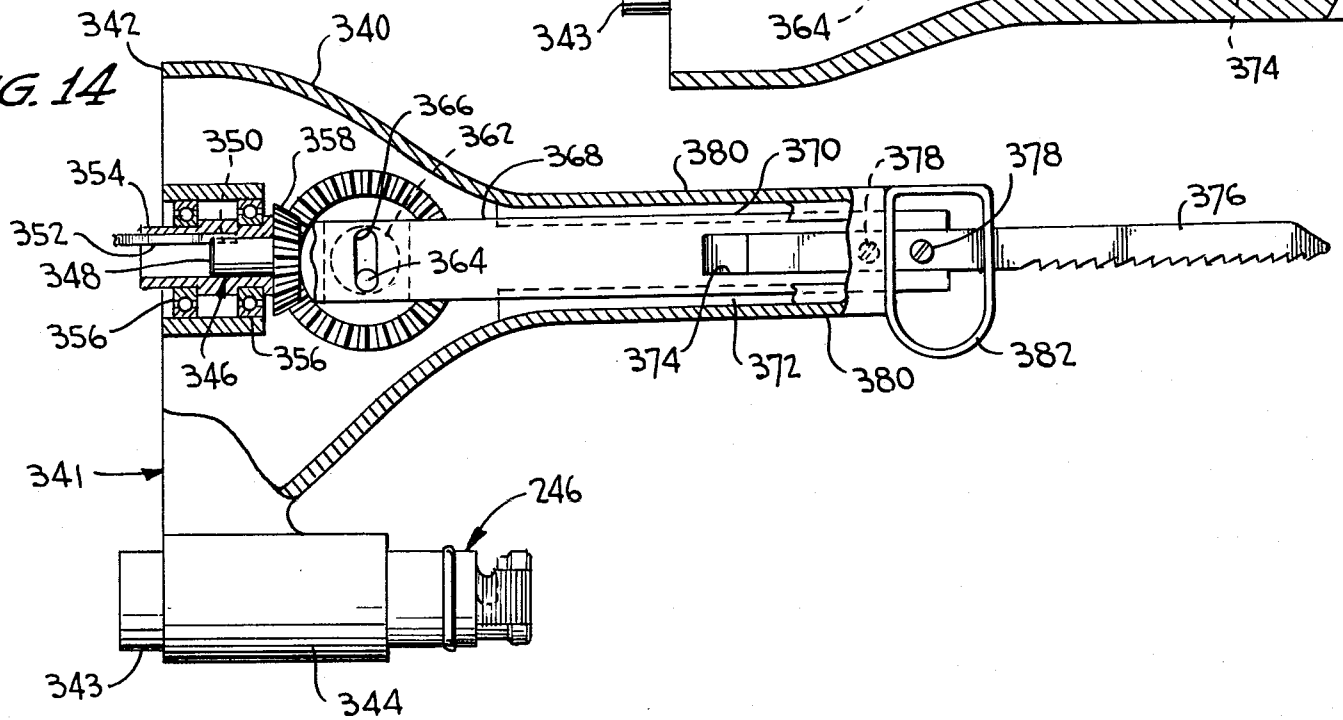
FIG. 14 is a side view partly in section of a reciprocating saw module for installation on the power module of the modular fire fighting apparatus of the present invention.

A reciprocating saw module 338 is illustrated in FIGS. 14 and 15 for mounting on the power module via elongate bolts, not shown, in the same manner as explained above with respect to the drill module, the reciprocating saw module 338 including a housing 340 mounting the bolts and having a coupling face 341 defined by a peripheral wall 342 adapted to abut the peripheral wall 181 of the power module with a tubular connector 343 extending within the outlet 182 of the power module. The tubular connector 343 is held in an inlet 344 formed in the housing 340 which supplies fluid to an outlet which carries a hollow male coupling 246. A driven member 346 has a shaft 348 with a groove 350 therein to receive a rib 352 in a sleeve coupling 354 rotatably mounted by means of bearings 356 within the housing 340, the drive shaft 86 of the power module engaging the rib 352 such that the driven member 346 is splined with the drive shaft 86 for rotation therewith. The shaft 348 carries a bevelled gear 358 which engages a bevelled gear 360 secured to a shaft 362 rotatably mounted in the housing 340 by bearings 363, the shaft 362 carrying an off-center pin 364 at its end extending through a slot 366 in a reciprocating member 368 such that rotation of the pin 364 about the axis of the shaft 362 creates a cam action causing the member 368 to reciprocate with a stroke equal to twice the radial spacing of the pin 364 from the axis of the shaft 362. The reciprocating member 368 is slidably mounted in longitudinal guides 370 and 372 and has a recessed end 374 receiving a saw blade 376 secured to the reciprocating member 368 by means of screws 378. The housing 340 has a necked portion 380 mounting the guide members 370 and 372, and at the end of the necked portion 380 is mounted a support 382 upon which the reciprocating saw module 338 can be rested during operation.

The operation of the fire fighting apparatus of the present invention utilizing the reciprocating saw module 338 is similar to that described above with respect to the drill module with a nozzle 264 having a female coupling 256 mounted on male coupling 246 extending from the passage 344 in the housing 340.

The saw blade 376 is reciprocated under the control of the power module by rotation of the driven member 346 via the drive shaft 86 to rotate the bevelled gears 358 and 360 which rotate shaft 362 carrying pin 364 to cause member 368 to reciprocate within the necked portion of the housing.

Figure 16:
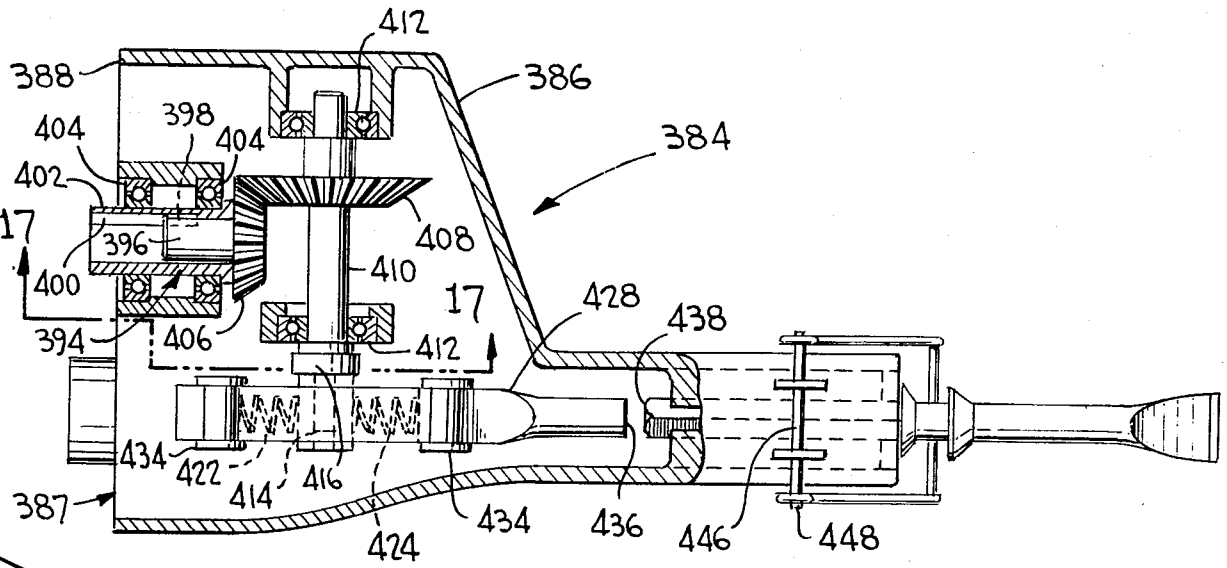
FIG. 16 is a side view partly in section of an impact tool module for installation on the power module of the modular fire fighting apparatus of the present invention.
Figure 17:
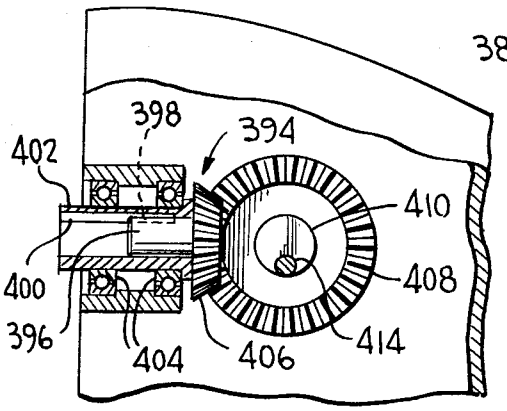
FIG. 17 is a section taken along line 17—17 of FIG. 16 illustrating the drive mechanism for the impact tool module.
Figure 18:
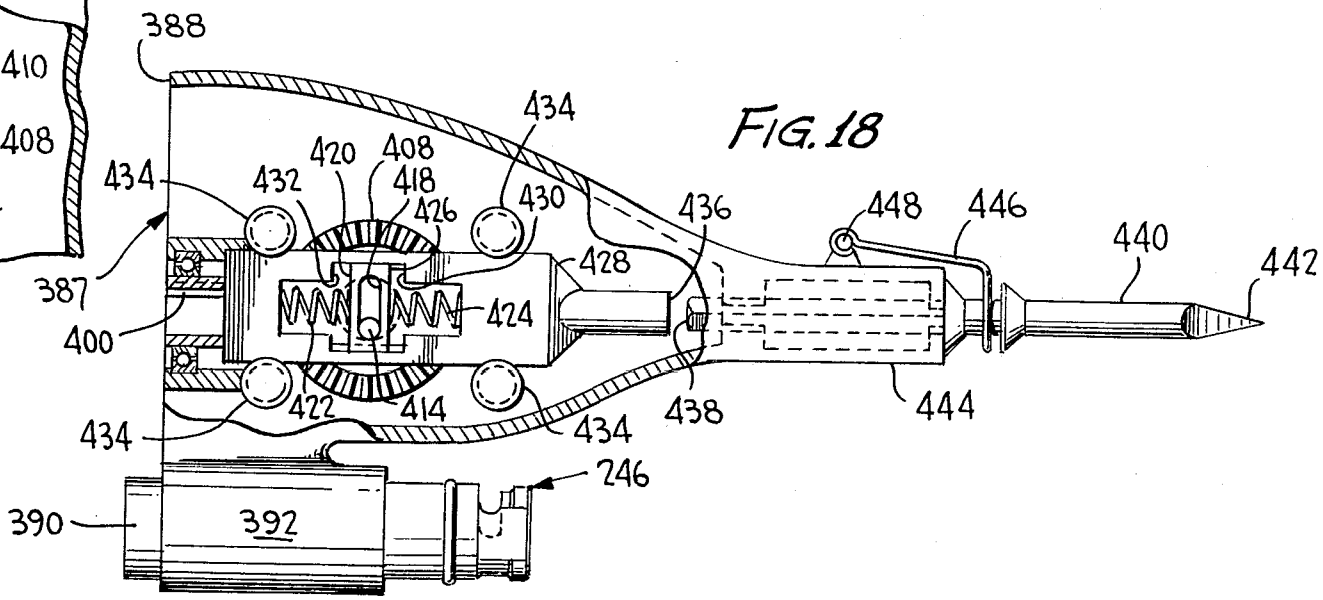
FIG. 18 is a top view partly in section of the impact tool module.

An impact tool module 384 is illustrated in FIGS. 16, 17 and 18 and includes a housing 386, preferably made of cast aluminum, having a configuration similar to the housing 340 of the reciprocating saw module 338. The housing 386 is mounted on the power module 22 via elongate bolts in the same manner as explained above with respect to the drill module, the housing 386 having a coupling face 387 defined by a peripheral wall 388 for engaging the peripheral wall 181 of the power module with a tubular connector 390 extending within the outlet 182 of the power module and secured in an inlet 392 in the housing 386 for supplying water to a hollow male coupling member 246. A driven member 394 has a shaft 396 with a groove 398 therein to receive a rib 400 in a sleeve coupling 402 rotatably mounted by means of bearings 404 within the housing, the drive shaft 86 of the power module engaging the rib 400 such that the driven member 394 is splined with the drive shaft for rotation therewith. The shaft 396 carries a bevelled gear 406 which engages a bevelled gear 408 secured to a shaft 410 rotatably mounted in the housing 386 by means of bearings 412. The shaft 410 carries an off-center pin 414 extending from a collar 416 and received in a slot 418 of a block 420 mounted by means of helical springs 422 and 424 within an opening 426 in a hammer 428, the opening 426 having a front shoulder 430 and a rear shoulder 432. The hammer 428 is mounted to reciprocate within the housing 386 by guide wheels 434 and carries a head 436 for abutment against an end 438 of an impact member 440 having a tapered tip 442. The impact member 440 is mounted in a necked portion 444 of the housing to permit slight movement while being held in place by means of a bail 446 pivotally mounted on the housing 386 by means of a pin 448.

In operation, the impact tool module 384 is mounted on the power module 22 such that water under the control of the spray control valve 57 is supplied to inlet 392, and a nozzle 264 is mounted on coupling 246 to permit the water to be supplied to a fire area under the control of the spray control valve. The rotational movement from drive shaft 86 is translated to reciprocating movement of the hammer 428 via the gears 406 and 408 which rotate shaft 410 and cause reciprocating movement of block 420 within opening 426 via cam action pin 414, the block 420 initially moving the hammer 428 to the right looking at FIG. 18 by means of spring 424 until head 436 abuts end 438. Thereafter, an impact force is supplied by abutment of block 420 with front shoulder 430 of the hammer; and, upon the return stroke, a similar operation is produced such that the impact hammer 440 operates in a vibratory manner.

Figure 19:
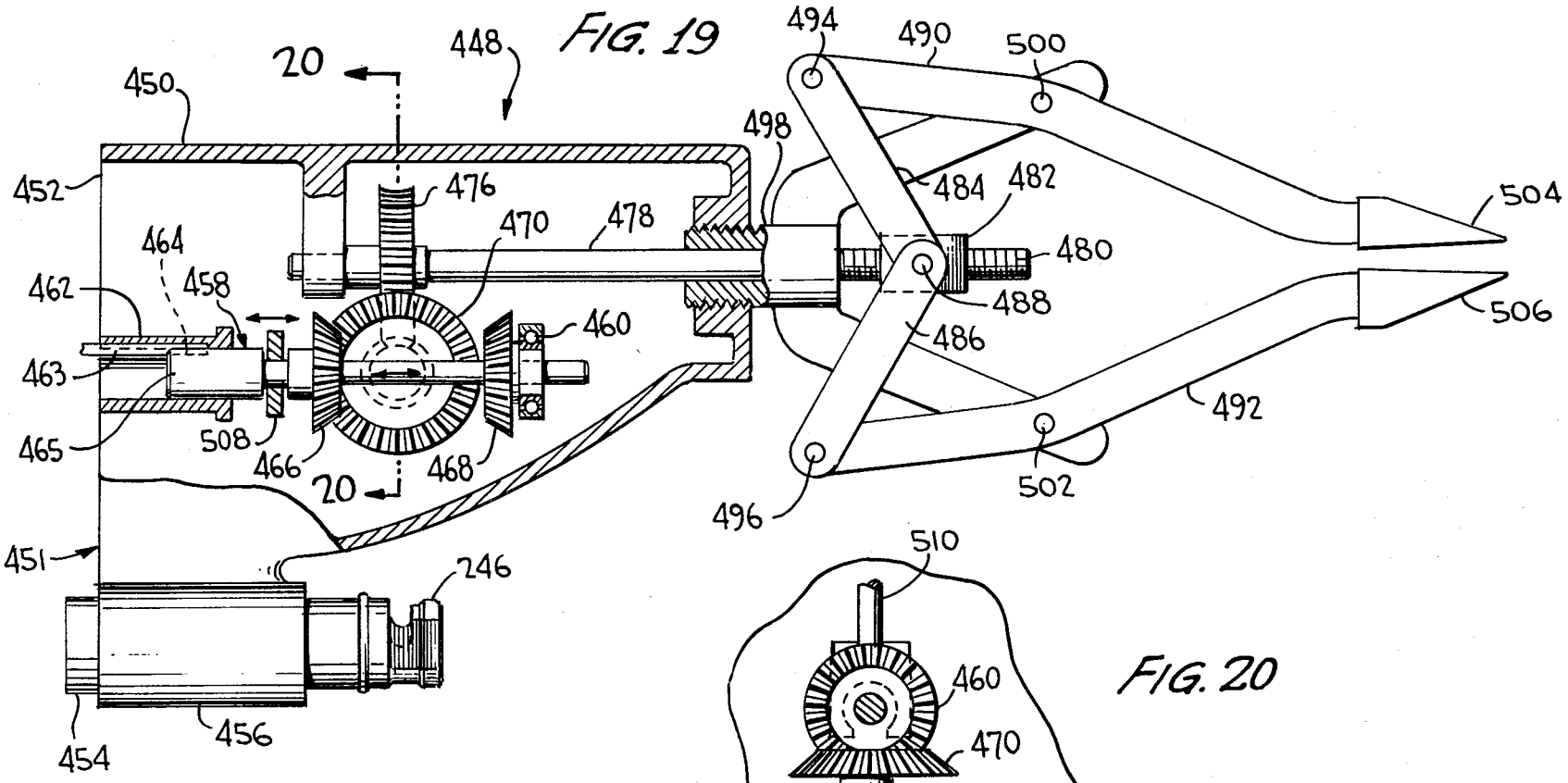
FIG. 19 is a top view partly in section of an expanding and contracting tool module for installation on the power module of the modular fire fighting apparatus of the present invention.
Figure 20:
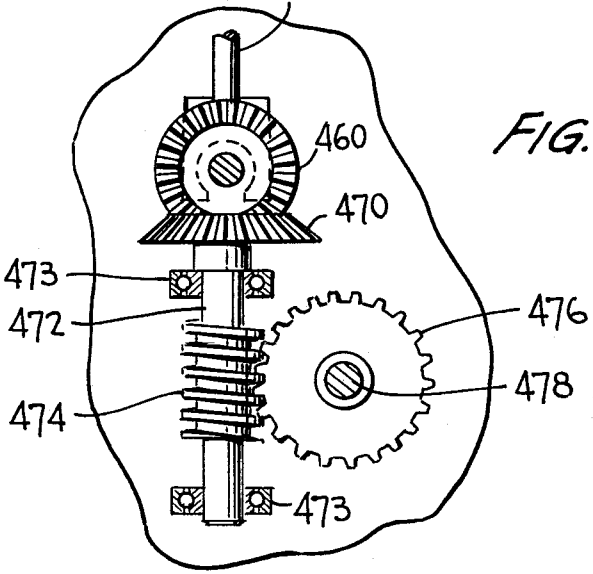
FIG. 20 is a section taken along line 20—20 of FIG. 19 illustrating the drive mechanism for the expanding and contracting tool module.

An expanding and contracting tool module 448 is illustrated in FIGS. 19 and 20 and includes a housing 450, preferably made of cast aluminum, having a coupling face 451 defined by a peripheral wall 452 for engaging the peripheral wall 181 of the power module such that the housing 450 can be secured to the power module via elongate bolts (not shown) in the same manner as described above with respect to the drill module. A tubular connector 454 extends within the outlet 182 of the power module to supply water to an inlet passage 456 in the housing 450, the inlet passage communicating with a hollow male coupling 246 for receiving a nozzle 264. A driven member, generally indicated at 458, is rotatably mounted in bearings 460 within the housing 450 and is driven in splined fashion via a sleeve coupling 462 having a rib 463 received in a groove 464 in a shaft 465 of the driven member and engaging the drive shaft 86 of the power module. The shaft 465 carries spaced, bevelled gears 466 and 468 arranged such that one or the other engages a bevelled gear 470 which, as best shown in FIG. 20, is secured to a shaft 472 rotatably mounted in bearings 473 and carrying a worm 474 engaging a gear 476. The gear 476 is secured to a rotatably mounted shaft 478 which has an externally threaded end 480 threadedly engaging an internally threaded collar 482. Arms 484 and 486 are pivotally mounted to collar 482 at a pin 488, and arms 484 and 486 are pivotally mounted at their opposite ends to the ends of elongate arms 490 and 492 via pins 494 and 496, respectively. The arms 490 and 492 are pivotally mounted on a U-shaped bracket 498 threadedly mounted on the end of housing 450 by means of pins 500 and 502, respectively, the elongate arms 490 and 492 having tapered ends 504 and 506 adapted to be inserted in a small area to expand and increase the size of the opening. The driven member 464 is slidable within the housing, as noted by the arrows, by means of a yoke 508 connected with a shift lever 510 extending out of the housing, movement of the shift lever selectively engaging gear 466 or gear 468 with gear 470.

In operation, water flow is conducted through inlet passage 456 in the same manner as described above, and the rotational movement of the drive shaft 86 of the power module is utilized to expand or contract the elongate arms 490 and 492 in accordance with the position of the bevelled gears 466 and 468. With bevelled gear 466 engaging gear 470, as illustrated in FIG. 19, bevelled gear 470 will be rotated clockwise looking at FIG. 20 to, in turn, rotate gear 476 and shaft 478 clockwise and cause the collar 482 to be moved to the left looking at FIG. 19 thereby contracting the arms to bring the ends 504 and 506 closer together. With gear 468 engaging bevelled gear 470, the collar 482 will be moved to the right looking at FIG. 19 due to rotation to the shaft 478 thereby expanding the arms to cause the ends 504 and 506 to move away from one another.

Any of the penetrating and extinguishing tool modules described above can be simply and interchangeably mounted on the power module via the elongate bolts since the fluid receiving inlet and the driven member on each penetrating and extinguishing tool module housing are aligned relative to the elongate bolts at the coupling face such that when the bolts are threadedly received in the holes in the coupling face of the power module housing, the driven member will releasably engage the drive shaft via the sleeve coupling and the tubular connector will be received in the outlet of the power module housing. Similarly, the peripheral walls of the coupling faces of the power module housing and the penetrating and extinguishing tool module housings are configured to abut each other leaving only the gap at the bottom for communication with the ambient and water drainage. The various nozzles extensions and bits can similarly be easily installed due to the simple fluid-tight hydraulic and mechanical connection provided by the male and female couplings of the present invention.

Use of the modular fire fighting apparatus is facilitated by the positioning of the various valve controls for operation by a single hand of an operator. In particular, the pivotal mounting of the drive control valve lever to extend along the supply inlet handle has the advantage of permitting precise valve control while grasping the apparatus firmly thereby allowing a single person to handle the modular fire fighting apparatus efficiently.

Inasmuch as the present invention is subject to many variations, modifications and changes in detail, it is intended that all subject matter discussed above or shown in the accompanying drawings be interpreted as illustrative and not in a limiting sense.

What is claimed is:

1. Modular fire fighting apparatus comprising a power module including a housing having a coupling face, a supply inlet for receiving fluid, a turbine chamber, discharge means communicating with said turbine chamber for exhausting fluid from said housing, an outlet positioned along said coupling face, and passage means establishing communication between said supply inlet and said turbine chamber and said outlet, valve means disposed in said passage means for controlling fluid flow to said turbine chamber and said outlet, and turbine means disposed in said housing having an impeller rotatably mounted in said turbine chamber for rotation by fluid flow in said turbine chamber, and a drive shaft secured to said impeller for rotation therewith and extending through said coupling face;

a penetrating and extinguishing tool module including a housing having a coupling face for abutment against said coupling face of said power module housing, and an inlet for alignment with said outlet of said power module housing, a driven member rotatably mounted in said penetrating and extinguishing tool module housing to extend through said coupling face, coupling means for releasable rectilinear engagement of said driven member coaxial with said drive shaft, a penetrating tool mounted on said penetrating and extinguishing tool module housing, and drive means coupling said driven member with said penetrating tool to drive said penetrating tool; and securing means for releasably mounting said penetrating and extinguishing tool module on said power module with said coupling face of said penetrating and extinguishing tool module housing in abutment against said coupling face of said power module housing to position said inlet of said penetrating and extinguishing tool module housing in communication with said outlet of said power module housing and to engage said driven member with said drive shaft whereby said penetrating and extinguishing tool module can be simply installed on sand removed from said power module.

2. Modular fire fighting apparatus as recited in claim 1 wherein said coupling means includes sleeve coupling means for engaging said drive shaft of said power module and said driven member, said sleeve coupling means having rotatably mounted in said penetrating and extinguishing tool module housing.

3. Modular fire fighting apparatus as recited in claim 1 wherein said penetrating and extinguishing tool module includes a tubular connector disposed in said inlet of said penetrating and extinguishing tool module housing and adapted to be received within said outlet of said power module housing.

4. Modular fire fighting apparatus as recited in claim 1 wherein said coupling face of said power module housing is defined by a peripheral wall having a plurality of threaded holes therein and said securing means includes a plurality of elongate bolts extending through said penetrating and extinguishing tool module housing to be received in said threaded holes in said peripheral wall in said power module housing.

5. Modular fire fighting apparatus as recited in claim 1 wherein said penetrating tool is a drill and said drive means includes gear means for rotating said drill.

6. Modular fire fighting apparatus as recited in claim 5 wherein said drive means includes a hollow tubular spindle driven by said gear means, rotatably mounted in said penetrating and extinguishing module housing and having openings therein for receiving fluid from said inlet of said penetrating and extinguishing module housing, and further comprising nozzle means mounted on said spindle for rotation therewith, said drill being mounted on said nozzle means.

7. Modular fire fighting apparatus as recited in claim 6 wherein said nozzle means includes a spray head having a central bore therethrough and passage means extending therethrough communicating with said central bore for spraying fluid, piston means slidably disposed in said central bore having tubular means extending therethrough to supply fluid to said drill, and bias means resiliently forcing said piston means to a position to block fluid flow to said passage means, said piston means being slidable to unblock said passage means when pressure from fluid flow overcomes said bias means.

8. Modular fire fighting apparatus as recited in claim 1 wherein said penetrating tool is a circular saw blade and said drive means includes belt and pulley means for rotating said circular saw blade.

9. Modular fire fighting apparatus as recited in claim 8 wherein said penetrating and extinguishing tool module housing is formed of first and second slidably connected parts, and said belt and pulley means includes a first pulley rotatably mounted in said first housing part and driven by said driven member, a second pulley rotatably mounted in said second housing part and a belt engaging said first and second pulleys, said first and second housing parts being slidable relative to each other to vary tension on said belt.

10. Modular fire fighting apparatus as recited in claim 9 wherein said first housing part includes passage means extending from said inlet of said penetrating and extinguishing tool module housing to a position adjacent an edge of said circular saw blade and terminating thereat at a hydraulic coupling.

11. Modular fire fighting apparatus as recited in claim 8 wherein said penetrating and extinguishing tool module includes a rotatably mounted shield covering substantially half of said circular saw blade, clamp means for securing said shield in various positions, nozzle means positioned on said shield for spraying liquid on said saw blade and passage means for supplying liquid from said inlet of said penetrating and extinguishing tool module housing to said nozzle means.

12. Modular fire fighting apparatus as recited in claim 1 wherein said penetrating tool is an impact tool and said drive means includes gear and cam means and a hammer reciprocated by said gear and cam means to abut said impact tool.

13. Modular fire fighting apparatus as recited in claim 12 wherein said gear and cam means includes a rotatably driven shaft carrying an off-set pin and a block resiliently mounted in an opening in said hammer and having a slot therein receiving said pin to cause said block to reciprocate and drive said hammer.

14. Modular fire fighting apparatus as recited in claim 1 wherein said penetrating tool is a reciprocating saw blade and said drive means includes gear and cam means for reciprocating said saw blade.

15. Modular fire fighting apparatus as recited in claim 14 wherein said gear and cam means includes a rotatably driven shaft carrying an off-set pin and a reciprocating member slidably mounted in said penetrating and extinguishing tool module housing carrying said saw blade, said reciprocating member having a slot therein receiving said pin to cause said member to reciprocate said saw blade.

16. Modular fire fighting apparatus as recited in claim 1 wherein said penetrating tool is an expanding and contracting tool and said drive means includes gear means driving said expand-and contracting tool.

17. Modular fire fighting apparatus as recited in claim 16 wherein said expanding and contracting tool includes elongate arms pivotally mounted on said penetrating and extinguishing tool module housing and having ends movable toward and away from one another and said drive means includes a rotatable shaft threadedly engaging a collar coupled with said elongate arms, said rotatable shaft being selectively rotated by said driven member in opposite directions to control movement of said elongate arms.

18. Modular fire fighting apparatus as recited in claim 1 wherein said penetrating and extinguishing tool module housing includes an outlet communicating with said inlet, and further comprising nozzle means coupled with said penetrating and extinguishing tool module housing in communication with said outlet.

19. Modular fire fighting apparatus as recited in claim 18 wherein said penetrating and extinguishing tool module housing includes a male coupling extending from said outlet and said nozzle means includes a female coupling adapted to engage said male coupling, said male coupling including an end having a flat side surface terminating at a shoulder and a circumferential groove extending from said flat surface adjacent said shoulder and said female coupling includes a pin mounted in a cylindrical recess to be longitudinally moved along said flat surface of said male coupling and rotatably moved into said circumferential groove.

20. Modular fire fighting apparatus as recited in claim 19 wherein said male coupling includes an O-ring seal spaced from said shoulder to engage the inner surface of said recess of said female coupling.

21. Modular fire fighting apparatus as recited in claim 1 wherein said valve means includes a drive control valve controlling fluid flow to said turbine chamber, and control means for operating said drive control valve including stop means for limiting initial opening of said drive control valve.

22. Modular fire fighting apparatus as recited in claim 21 wherein said supply inlet is formed in a handle extending from said power module housing, and said control means includes a lever pivotally mounted on said housing to extend along said supply inlet handle and gear and cam means responsive to pivotal movement of said lever to operate said drive control valve.

23. Modular fire fighting apparatus as recited in claim 22 wherein said stop means includes a stop mounted on said power module housing, a member pivotally mounted on said lever and means biasing said member to a position to abut said stop to limit pivotal movement of said lever.

24. Modular fire fighting apparatus comprising a power module including a housing having a coupling face, a supply inlet for receiving fluid, a turbine chamber, discharge means communicating with said turbine chamber for exhausting fluid from said housing, an outlet positioned along said coupling face, and passage means establishing communication between said supply inlet and said turbine chamber and said outlet, valve means disposed in said passage means for controlling fluid flow to said turbine chamber and said outlet, and turbine means disposed in said housing having an impeller rotatably mounted in said turbine chamber for rotation by fluid flow in said turbine chamber, and a drive shaft secured to said impeller for rotation therewith and extending through said coupling face;

a penetrating and extinguishing tool module including a housing having a coupling face for abutment against said coupling face of said power module housing, an inlet for alignment with said outlet of said power module housing and an outlet communicating with said inlet, a driven member rotatably mounted in said penetrating and extinguishing tool module housing to extend through said coupling face for releasable engagement with said drive shaft, a penetrating tool mounted on said penetrating and extinguishing tool module housing, and drive means coupling said driven member with said penetrating tool to drive said penetrating tool;

securing means for releasably mounting said penetrating and extinguishing tool module on said power module with said coupling face of said penetrating and extinguishing tool module housing in abutment against said coupling face of said power module housing to position said inlet of said penetrating and extinguishing tool module housing in communication with said outlet of said power module housing and to engage said driven member with said drive shaft whereby said penetrating and extinguishing tool module can be simply installed on and removed from said power module; and nozzle means coupled with said penetrating and extinguishing tool module housing in communication with said outlet including a spray head having a central bore with passage means communicating with said central bore, a piston slidably mounted in said central bore, and bias means resiliently forcing said piston means to a position to block fluid flow through said passage means, said piston means being movable by fluid pressure to unblock said passage means to permit fluid flow therethrough.

25. Modular fire fighting apparatus as recited in claim 24 wherein said passage means includes a plurality of angularly oriented passages circumferentially distributed around said spray head.

26. Modular fire fighting apparatus as recited in claim 25 wherein said nozzle means includes a collar threadedly engaging said spray head and having a peripheral lip disposed adjacent said passages to control the orifice size of said passages.

27. Modular fire fighting apparatus comprising a power module including a housing having a coupling face, a supply inlet for receiving fluid, a turbine chamber, discharge means communicating with said turbine chamber for exhausting fluid from said housing, an outlet positioned along said coupling face, and passage means establishing communication between said supply inlet and said turbine chamber and said outlet, valve means disposed in said passage means for controlling fluid flow to said turbine chamber and said outlet, said valve means including a spray control valve controlling fluid flow to said outlet of said power module housing including a cylindrical cavity formed in said power module housing, a valve seat opening disposed in a side wall of said cavity and a cylindrical valve member rotatably disposed in said cavity having a side wall with an aperture therein for alignment with said valve seat opening when said spray control valve is open and a slot in said side wall forming a resilient flap portion for alignment with said valve seat opening when said spray control valve is closed whereby fluid pressure in said valve member forces said resilient flap portion against said valve seat opening to seal said spray control valve closed, and turbine means disposed in said housing having an impeller rotatably mounted in said turbine chamber for rotation by fluid flow in said turbine chamber, and a drive shaft secured to said impeller for rotation therewith and extending through said coupling face;

a penetrating and extinguishing tool module including a housing having a coupling face for abutment against said coupling face of said power module housing, and an inlet for alignment with said outlet of said power module housing, a driven member rotatably mounted in said penetrating and extinguishing tool module housing to extend through said coupling face for releasable engagement with said drive shaft, a penetrating tool mounted on said penetrating and extinguishing tool module housing, and drive means coupling said driven member with said penetrating tool to drive said penetrating tool; and securing means for releasably mounting said penetrating and extinguishing tool module on said power module with said coupling face of said penetrating and extinguishing tool module housing in abutment against said coupling face of said power module housing to position said inlet of said penetrating and extinguishing tool module housing in communication with said outlet of said power module housing and to engage said driven member with said drive shaft whereby said penetrating and extinguishing tool module can be simply installed on and removed from said power module.

28. Modular fire fighting apparatus as recited in claim 27 wherein said slot in said side wall of said valve member has a longitudinal portion and a circumferential portion.

29. A power module for driving a penetrating and extinguishing tool module for use in fire fighting comprising housing means including a tubular handle forming a supply inlet for receiving fluid, a turbine chamber, discharge means communicating with said turbine chamber for exhausting fluid from said housing means, outlet means for supplying fluid to the penetrating and extinguishing tool module, first passage means establishing communication between said supply inlet and said turbine chamber and second passage means establishing communication between said supply inlet and said outlet means;

turbine means disposed in said housing means having an impeller rotatably mounted in said turbine chamber, and a drive shaft secured to said impeller for rotation therewith;

drive control valve means disposed in said first passage means for controlling fluid flow to said turbine chamber;

separate spray control valve means disposed in said second passage means for controlling fluid flow to said outlet means; and control means for operating said drive control valve means including a lever pivotally mounted on said housing means and extending along said supply inlet handle, and stop means carried on said lever for limiting movement of said lever to control initial opening of said drive control valve means to initially drive said impeller at a slow speed, said stop means being releasable to permit further movement of said lever and additional opening of said drive control valve means to increase the speed of said impeller whereby an operator can use a hand to grip said supply inlet handle and support said power handle while using the fingers of the hand to pivot said lever and independently operate said stop means to control said drive control valve means.

30. A power module as recited in claim 29 wherein said stop means includes a stop mounted on said housing means, a member movably mounted on said lever and bias means normally placing said member in a position to abut said stop to limit pivotal movement of said lever.

31. A power module as recited in claim 30 wherein said member is pivotally mounted on said lever and said bias means includes a spring urging said member to said abutting position, said member extending from said lever to be engaged by a finger of an operator to be pivoted against the force of said spring to permit further pivotal movement of said lever.

32. A power as recited in claim 30 wherein said control means includes a safety lock carried on said lever and having a normal position abutting said supply inlet handle to prevent pivotal movement of said lever, said safety lock being movable from said normal position to permit pivotal movement of said lever.

33. A power module as recited in claim 32 wherein said control means includes first spring means biasing said lever away from said supply inlet handle and second spring means biasing said safety lock to said normal position.

34. A power module for driving a penetrating and extinguishing tool module for use in fire fighting comprising housing means including a tubular handle forming a supply inlet for receiving fluid, a turbine chamber, discharge means communicating with said turbine chamber for exhausting fluid from said housing means, outlet means for supplying fluid to the penetrating and extinguishing tool module, first passage means establishing communication between said supply inlet and said turbine chamber and second passage means establishing communication between said supply inlet and said outlet means;

turbine means disposed in said housing means having an impeller rotatably mounted in said turbine chamber, and a drive shaft secured to said impeller for rotation therewith;

drive control valve means disposed in said first passage means for controlling fluid flow to said turbine chamber;

spray control valve means disposed in said second passage means for controlling fluid flow to said outlet means; and control means for operating said drive control valve means including a lever pivotally mounted on said housing means and extending along said supply inlet handle whereby an operator can use a hand to grip said supply inlet handle and support said power handle while using the fingers of the hand to pivot said lever and operate said drive control valve means, said control means including gear and cam means responsive to pivotal movement of said lever to operate said drive control valve means, said drive control valve means including a valve seat disposed in said first passage means and a valve member carried on a longitudinally movable valve stem, and said gear and cam means including a rack carried on said lever, a pinion rotatably mounted in said housing means engaging said rack and carrying an off-set pin, and a block connected with said valve stem and having a slot therein receiving said pin such that rotation of said pinion in response to pivotal movement of said rack produces longitudinal movement of said block and said valve member.

35. A power module for driving a penetrating and extinguishing tool module for use in fire fighting comprising housing means including a tubular handle forming a supply inlet for receiving fluid, a turbine chamber, discharge means communicating with said turbine chamber for exhausting fluid from said housing means, outlet means for supplying fluid to the penetrating and extinguishing tool module, first passage means establishing communicating between said supply inlet and said turbine chamber and second passage means establishing communication between said supply inlet and said outlet means;

turbine means disposed in said housing means having an impeller rotatably mounted in said turbine chamber, and a drive shaft secured to said impeller for rotation therewith;

drive control valve means disposed in said first passage means for controlling fluid flow to said turbine chamber;

spray control valve means disposed in said second passage means for controlling fluid flow to said outlet means; and control means for operating said drive control valve means including a lever pivotally mounted on said housing means and extending along said supply inlet handle whereby an operator can use a hand to grip said supply inlet handle and support said power handle while using the fingers of the hand to pivot said lever and operate said drive control valve means, said spray control valve means including a cylindrical cavity in said housing means having a valve seat opening therein, and a cylindrical valve member having an aperture therein for alignment with said valve seat opening when said spray control valve means is open, said valve member having a slot formed therein to form a flap portion aligned with said valve seat opening when said spray control valve means is closed whereby fluid pressure forces said flap portion to seal against said valve seat opening.

* * * * *